US009144359B2

(12) United States Patent
Gebhard et al.

(10) Patent No.: US 9,144,359 B2
(45) Date of Patent: Sep. 29, 2015

(54) CARPET CLEANING DEVICE

(71) Applicants: Albert W. Gebhard, Denver, CO (US); Vortex, LLC, Salisbury, NC (US)

(72) Inventors: Albert W. Gebhard, Denver, CO (US); Donavan J. Allen

(73) Assignees: Albert W. Gebhard, Denver, CO (US); Vortex, LLC, Salisbury, NC (US)

( * ) Notice: Subject to any disclaimer, the term of this patent is extended or adjusted under 35 U.S.C. 154(b) by 0 days.

(21) Appl. No.: 14/090,877

(22) Filed: Nov. 26, 2013

(65) Prior Publication Data

US 2014/0143976 A1 May 29, 2014

Related U.S. Application Data

(60) Provisional application No. 61/730,224, filed on Nov. 27, 2012.

(51) Int. Cl.
*A47L 11/34* (2006.01)
*A47L 11/40* (2006.01)

(52) U.S. Cl.
CPC ..... *A47L 11/34* (2013.01); *A47L 11/4088* (2013.01)

(58) Field of Classification Search
CPC ..... A47L 11/34; A47L 11/4088
USPC ..... 15/321, 322, 314, 354
IPC ..... A47L 11/34
See application file for complete search history.

(56) References Cited

U.S. PATENT DOCUMENTS

| | | | | |
|---|---|---|---|---|
| 787,388 | A | 4/1905 | Moorhead | |
| 2,497,435 | A | 2/1950 | Branneman, L. | |
| 3,774,262 | A | 11/1973 | Anthony et al. | |
| 4,168,562 | A | 9/1979 | Maasberg | |
| 4,392,270 | A * | 7/1983 | Magee | 15/322 |
| 4,521,935 | A * | 6/1985 | Johnston et al. | 15/322 |
| 4,542,556 | A | 9/1985 | Hepple | |
| 4,751,759 | A | 6/1988 | Zoell | |
| 4,884,315 | A | 12/1989 | Ehnert | |
| 4,951,346 | A | 8/1990 | Salmon | |
| 5,163,203 | A | 11/1992 | Tanasescu et al. | |
| 5,289,610 | A | 3/1994 | Monson | |
| 5,297,739 | A | 3/1994 | Allen | |
| 5,517,715 | A | 5/1996 | Monson | |
| 5,542,147 | A | 8/1996 | Merten | |
| 5,603,775 | A | 2/1997 | Sjoberg | |
| 6,151,748 | A | 11/2000 | Earhart, Jr. et al. | |
| 6,571,421 | B1 | 6/2003 | Sham et al. | |
| 6,725,500 | B2 | 4/2004 | Allen et al. | |
| 6,953,299 | B2 | 10/2005 | Wang et al. | |

(Continued)

*Primary Examiner* — David Redding
(74) *Attorney, Agent, or Firm* — Margaret Polson; Polson Intellectual Property Law, PC

(57) ABSTRACT

A carpet washing attachment with a vacuum hose attached to a washing head with a liquid line feeding water/cleaning fluid into washing head is disclosed. Washing head is formed of hollow members and a cover sealed to the top washing head with the vacuum hose attached to the cover. This forms cleaning area which is surrounded by the hollow members. Each of the hollow members has water jet holes located on the inner part of the washing head such that the water exiting the holes is projected inward so that the jets of water come to an apex and intersect at a given distance X from the bottom of the washing head. The angle of the jets and the spacing of members should be chosen such that the distance X is roughly the depth of the carpet pile to be washed.

4 Claims, 4 Drawing Sheets

(56) References Cited

U.S. PATENT DOCUMENTS 7,441,305 B2 10/2008 Cascio
7,788,765 B2 9/2010 Allen
2004/0134024 A1 7/2004 Allen

* cited by examiner

CARPET CLEANING DEVICE

CROSS REFERENCE APPLICATIONS

This application is a non-provisional application claiming the benefits of provisional application No. 61/730,224 filed Nov. 27, 2012, which is hereby incorporated by reference for all purposes.

BACKGROUND

Many carpet washing devices are known in the art. The various known devices always have to balance the wear on the carpet with the amount of cleaning provided. Many carpet cleaning devices have rotating brushes to scrub the carpet, however, this causes wear of the carpet fibers. In prior art carpet washing devices the water jet was given access to the base of the carpet pile by moving brushes contacting the carpet pile and moving to one side, allowing the water jets access to the base of the carpet pile. This contact of the brushes with the carpet pile increases wear on the carpet and can damage the carpet over time. The present design eliminates or reduces the manual friction of the carpet caused by the brushes.

Carpet cleaning devices that merely spray water on which is then vacuumed up are known, however this are generally less effective in getting dirt out of the carpet, particularly out of pile of the carpet.

The foregoing example of the related art and limitations related therewith are intended to be illustrative and not exclusive. Other limitations of the related art will become apparent to those of skill in the art upon a reading of the specification and a study of the drawings.

SUMMARY

One aspect of the present disclosure is to provide a carpet washing device that creates an agitating action without moving brushes.

Another aspect is to provide the vacuum air in the center of the spray of water jets, creating an agitation of the water and air, helping to remove more dirt from the carpet.

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

One embodiment of the present disclosure is carpet washing attachment with a vacuum hose attached to a washing head with a liquid line feeding water/cleaning fluid into washing head. Washing head is formed of hollow members and a cover sealed to the top washing head with the vacuum hose attached to the cover. This forms cleaning area which is surrounded by the hollow members. Each of the hollow members has water jet holes located on the inner part of the washing head such that the water exiting the holes is projected inward so that the jets of water come to an apex and intersect at a given distance X from the bottom of the washing head. The angle of the jets and the spacing of members should be chosen such that the distance X is roughly the depth of the carpet pile to be washed.

In addition to the exemplary aspects and embodiments described above, further aspects and embodiments will become apparent by reference to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION

Figure 1:
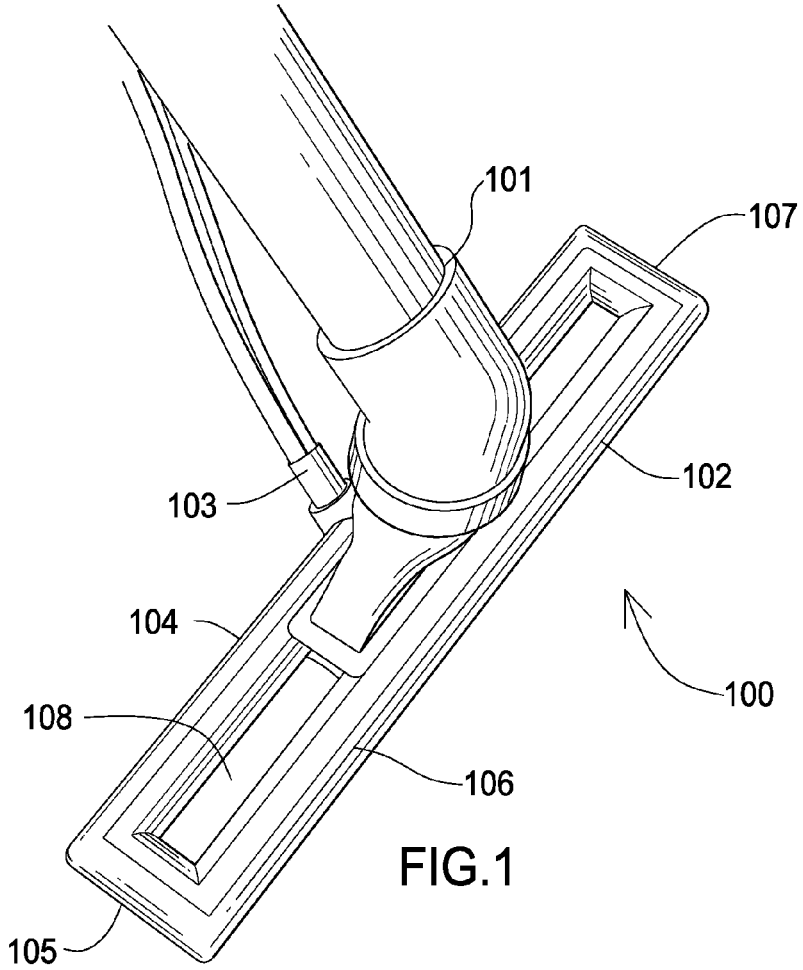
FIG. 1 is a top perspective view of a carpet washing attachment of the present disclosure.
Figure 2:
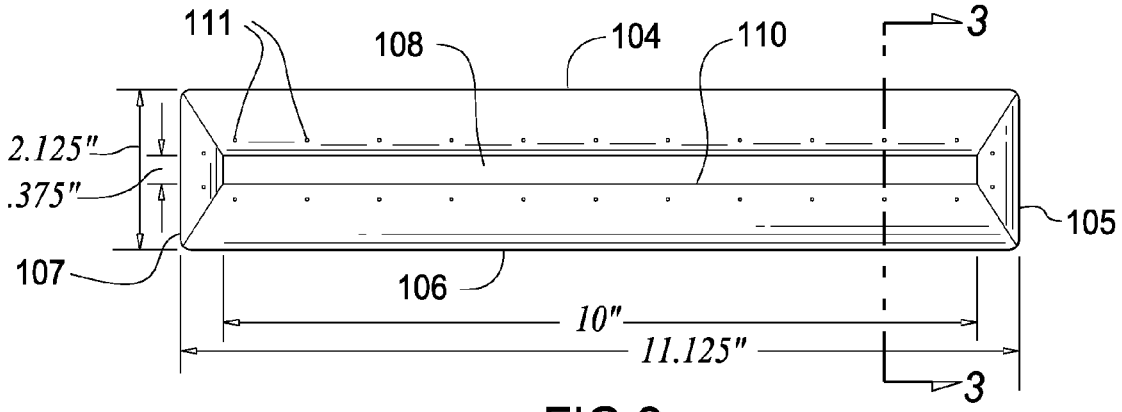
FIG. 2 is a bottom plan view of the carpet washing attachment.

Referring first to FIGS. 1 and 2, carpet washing attachment 100 with a vacuum hose 101 attached to a washing head 102. The washing attachment 100 has a liquid line 103 feeding water/cleaning fluid into washing head 102. Washing head 102 is formed of hollow members 104, 105, 106, and 107, formed into a rectangle in the depicted embodiment. A cover 108, which is transparent in the depicted embodiment, is sealed to the top washing head 102 with the vacuum hose 101 attached to the cover. This forms cleaning area 110 which is surrounded by the hollow members 104, 105, 106, and 107, seen in FIG. 2.

Figure 3:
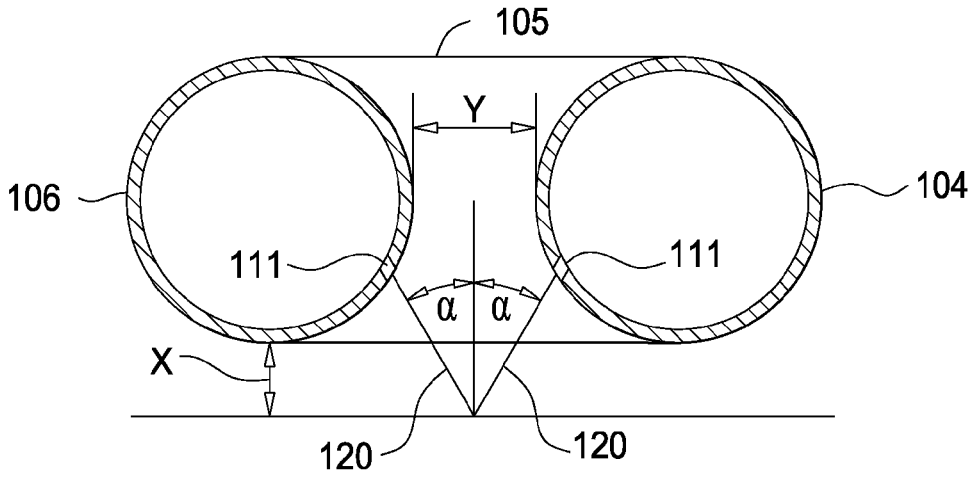
FIG. 3 is a cross sectional view of the carpet washing attachment taken along line 3-3 of FIG. 2.

Each of the hollow members has water jet holes 111 spaced along their length. The water jet holes 111 are located on the inner part of the washing head such that the water exiting the holes is projected inward so that the jets of water come to an apex and intersect at a given distance X from the bottom of the washing head, as seen in FIG. 3. The diameter of the water jet holes is chosen to ensure a strong jet of water that will reach the base of the carpet pile to ensure a strong scrubbing action. The exact size of the hole will depend on the size of the washing head, the available water pressure, the size of the water reservoir, the desired rate of us up of the water and other known design considerations for the overall design of the device. In the depicted embodiment the holes are place such that the water jets are coming out at 30 degrees from vertical as show by angle $\alpha$ and the space Y between 104 and 106 is $\frac{3}{8}^{th}$ of inch as shown in FIG. 2. The angle of the jets and the spacing of members 104, 106 should be chosen such that the distance X is roughly the depth of the carpet pile to be washed. This results the water jets coming together at the base of the carpet pile, creating maximum agitation of the carpet pile and removal of more debris. This reduces wear on the carpet and results in better cleaning of the carpet. The design also increase the surface area that water is being jetted onto and suction is being applied to over current designs. The dimensions the washing head, specifically the spacing of the members 104 and 106 and the angle of water jets need to be chosen to create this configuration. In one possible embodiment the spacing of members 104, 106 and/or the angle of the jets are adjustable to allow for different carpet pile depths.

Figure 4:
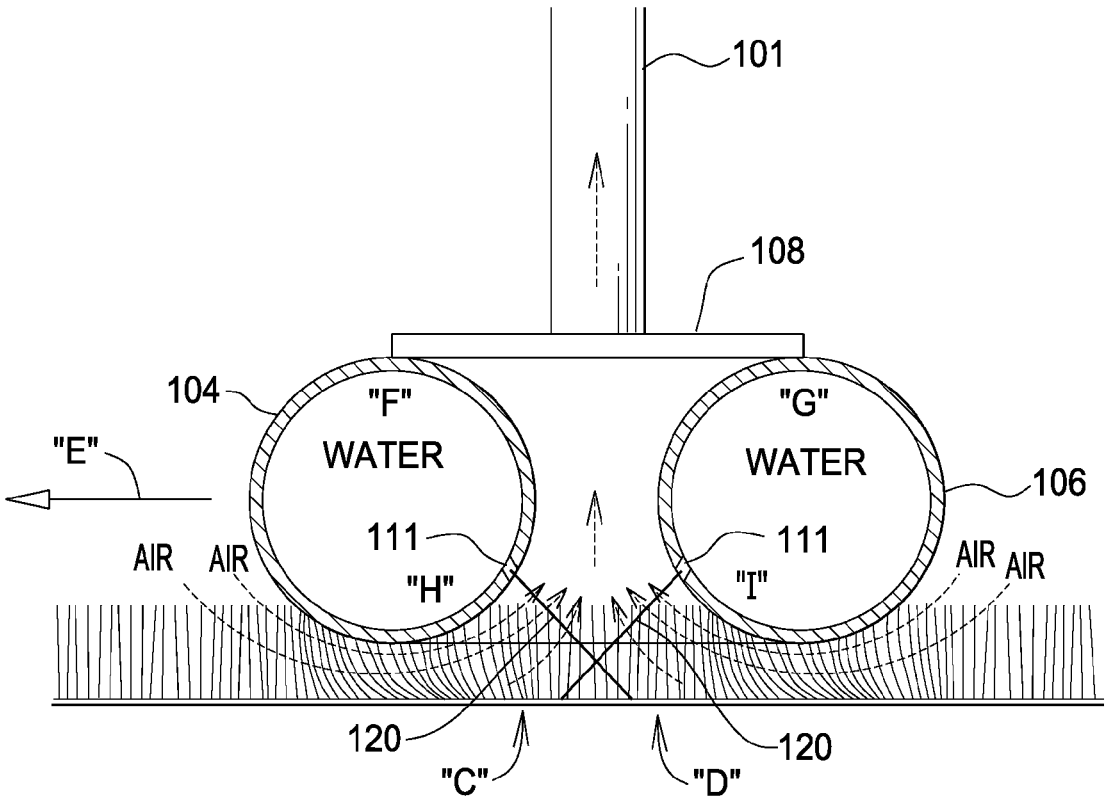
FIG. 4 is a cross sectional view of the carpet washing attachment in use.

As seen in FIG. 4, is use the water jets 120 are injected into the carpet pile P, as the vacuum hose 101 sucks air through the carpet pile and into the cleaning area 110 and then into vacuum hose 101. The water flows through hollow members and in is jetted into the carpet piles as the air is flowing through the carpet pile, creating a scrubbing action to loosen dirt without brushes. Depending on the angle of water jets and the depth of the carpet pile, the jets 120 may intersect before the base of the carpet pile as shown in FIG. 4.

Figure 5:
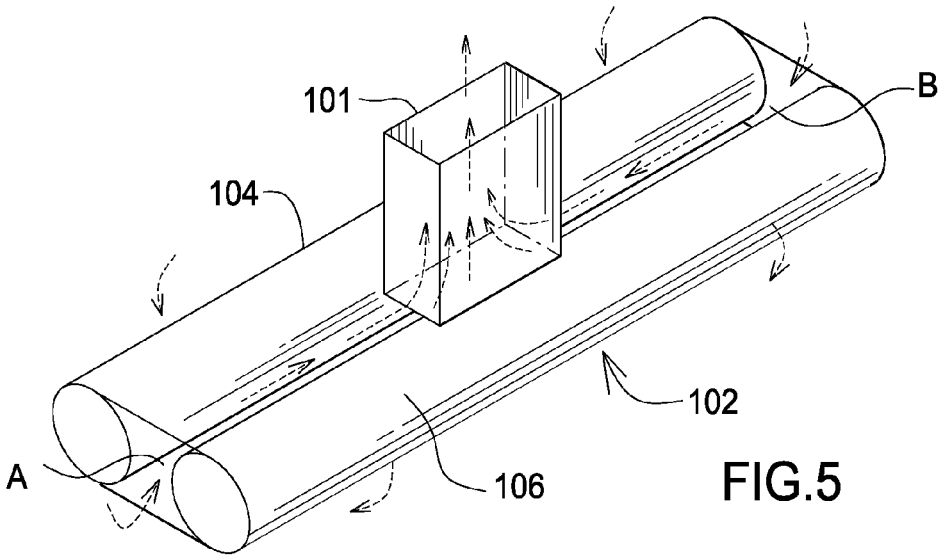
FIG. 5 is a partial view of the carpet washing attachment showing air flow.

FIG. 5 shows the air flow into the washing head 102. The air is pulled horizontally from the ends A and B, and in from the sides, as shown by the arrows. This is believed to create a further scrubbing action.

Figure 6:
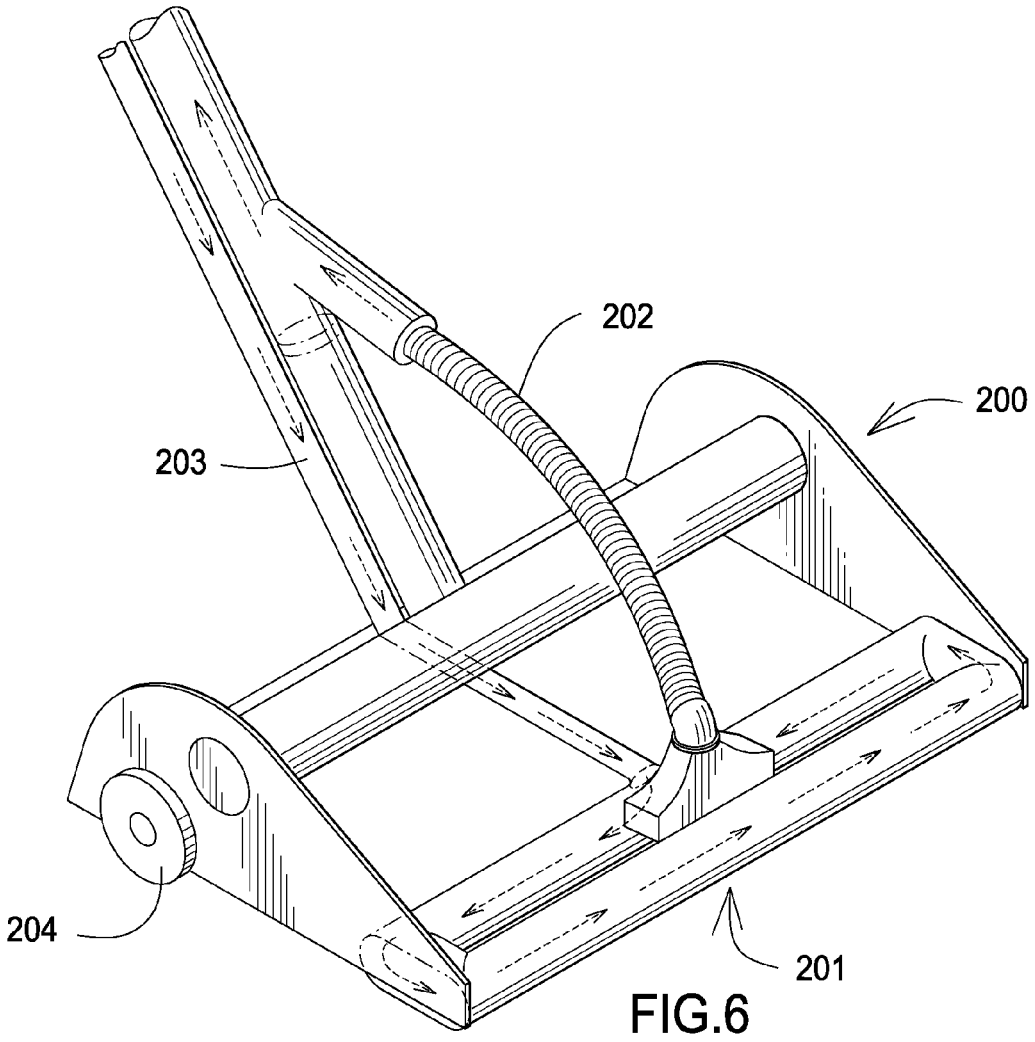
FIG. 6 is a top perspective view of another embodiment of the carpet washing device.

FIG. 6 shows an additional embodiment of the device. A housing 200 has washing head 201, which functions as described above. The vacuum line 202 provides the suction and carries the liquid and dirt away to a container (not shown). A liquid line 203 carries water and any cleaning fluids to the washing head 201 as described above. Wheels 204 are provided to make the device easier for most consumers to use.

Figure 7:
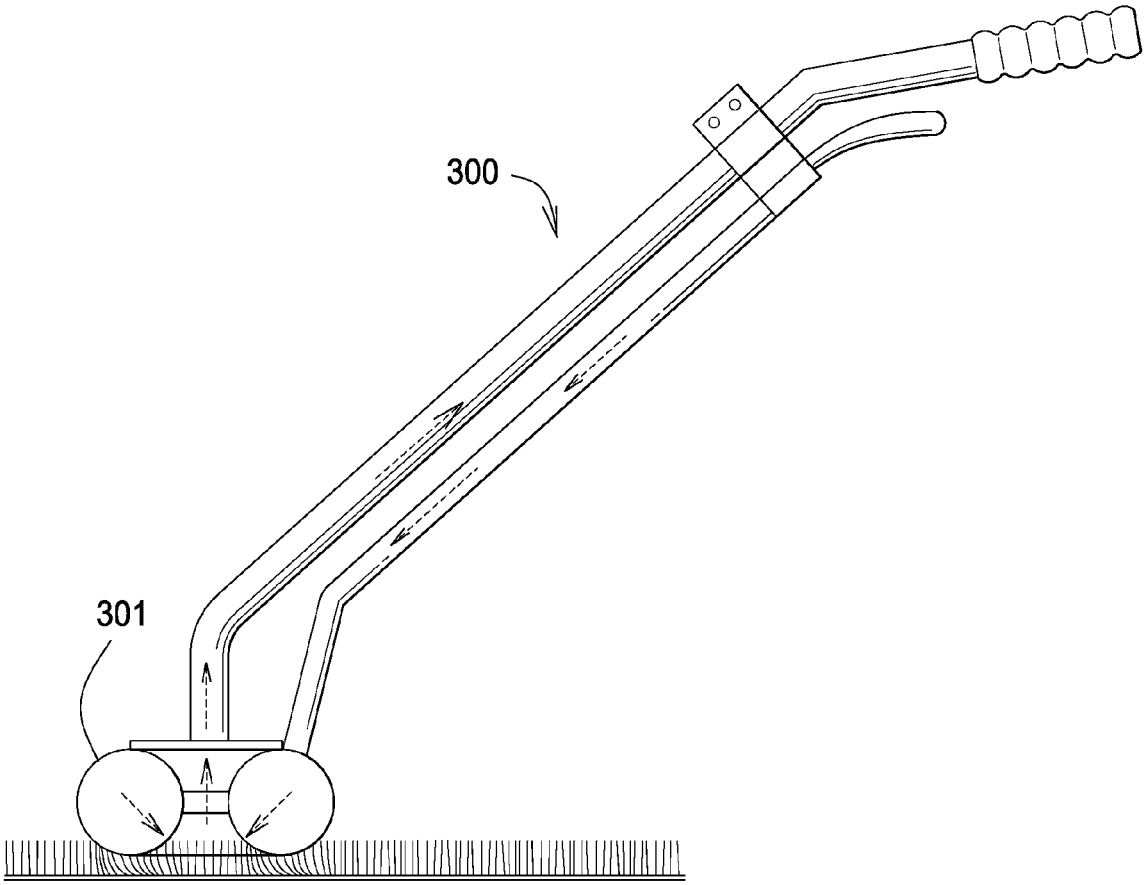
FIG. 7 is a side elevation view of another embodiment of the carpet washing device.

FIG. 7 shows an additional embodiment of the device. In this embodiment that standard commercial "wand" unit 300 is modified with the washing head 301 which functions as described above. This allows the unit to be used with standard truck mounted equipment used by commercial carpet cleaning operations.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true spirit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure. When a Markush group or other grouping is used herein, all individual members of the group and all combinations and subcombinations possible of the group are intended to be individually included in the disclosure.

In general the terms and phrases used herein have their art-recognized meaning, which can be found by reference to standard texts, journal references and contexts known to those skilled in the art. The above definitions are provided to clarify their specific use in the context of the invention.

We claim:

1. A carpet washing device comprising:

a washing head comprising at least four fluid connected hollow members, said hollow members enclosing a roughly rectangular cleaning space;

a vacuum hose attached to the washing head providing suction to the cleaning space;

a liquid line attached to the washing head to deliver liquid to the hollow members;

the hollow members having jet holes for directing water in controlled streams onto the surface to be cleaned, the jet holes arranged such that the streams of water are angled inward towards the inside of the cleaning space;

the jet holes producing a largely uni-directional stream of water;

wherein the jet holes are positioned such that the streams of water from at least one set of hollow members on opposing sides of the cleaning space from each other intersect at a distance X from a bottom of the cleaning head, the distance X being the depth of a carpet pile to be cleaned; and the two opposing streams of water combining to provide a scrubbing action to a carpet to be washed.

2. The carpet washing device of claim 1 wherein, the angle of the streams of water is at 30 degrees from the vertical.

3. The carpet washing device of claim 1 wherein the angle of the water streams is adjustable.

4. The carpet washing device of claim 1 wherein the spacing of the hollow members is adjustable.

* * * * *